United States Patent [19]

Abrahamian et al.

[11] Patent Number: 4,915,378

[45] Date of Patent: Apr. 10, 1990

[54] EXERCISING APPARATUS

[76] Inventors: Alexander Abrahamian; Joseph Abrahamian, both of Lot 2, Addison Street, Thirlmere, New South Wales 2572, Australia

[21] Appl. No.: 236,594

[22] Filed: Aug. 25, 1988

[30] Foreign Application Priority Data

Aug. 26, 1987 [AU] Australia ..... PI3989

[51] Int. Cl.[4] ..... A63B 21/00

[52] U.S. Cl. ..... 272/134; 272/117; 272/130; 272/145

[58] Field of Search ..... 272/72, 134, 118, 130, 272/131, 133, 145, 146, 903, 117, 70, 126, 142, 144, 120, 97; 128/25 R

[56] References Cited

U.S. PATENT DOCUMENTS

| | | | |
|---|---|---|---|
| 1,973,945 | 9/1934 | Chavin et al. | 272/134 |
| 2,261,355 | 11/1941 | Flynn | 128/25 R |
| 2,358,254 | 9/1944 | Sanders | 128/25 R |
| 3,189,344 | 6/1965 | Swarts . | |
| 3,912,260 | 10/1975 | Rice | 272/97 |
| 4,176,836 | 12/1979 | Coyle . | |
| 4,285,515 | 8/1981 | Gezari | 272/134 X |
| 4,346,886 | 8/1982 | Cox et al. | 272/72 |
| 4,372,551 | 2/1983 | Yurdin | 372/134 X |
| 4,511,137 | 4/1985 | Jones . | |
| 4,550,908 | 11/1985 | Dixon | 128/25 R |
| 4,629,180 | 12/1986 | Kaya | 272/145 X |
| 4,666,152 | 5/1987 | Jones . | |
| 4,700,946 | 10/1987 | Briednig | 272/134 |

FOREIGN PATENT DOCUMENTS

| | | | |
|---|---|---|---|
| 1135295 | 11/1982 | Canada . | |
| 0121902 | 10/1984 | European Pat. Off. . | |
| 2036818 | 12/1970 | France . | |
| 8803825 | 6/1988 | World Int. Prop. O. | 272/145 |

*Primary Examiner*—Richard J. Apley
*Assistant Examiner*—Robert Bahr
*Attorney, Agent, or Firm*—Irell & Manella

[57] ABSTRACT

The exercising apparatus disclosed is for particular use for th exercising and stretching of the leg and abdominal muscles. The apparatus allows for an upper body support to be pivoted about a horizontal axis while the feet support is slidable along an inclined slope. The resistance to such movements is variable depending on which particular muscles are to be stretched or worked. The resistance can take the form of a stack of weights or a braking system on the movement. The apparatus is able to be used with the user either resting his chest or back on the upper body support and with the inclined slope being able to be varied from substantially horizontal to approximately 70°.

19 Claims, 5 Drawing Sheets

EXERCISING APPARATUS

The present invention relates to an apparatus for the exercising of muscles associated with the limbs and with the torso, and in particular, to apparatus which provides a pivotable back or chest support with adjustable feet supports which provide a variety of exercising functions.

Many different types of exercising apparatss have been developed in the field of body building and body toning. Many such machines provide a linear resistance against the user whilst other machines provide variable resistance depending upon the actual position of the user. Also apparatuses have been developed which provide for movement where the body of the user is able to be pivoted against a resistance in order to build or tone muscles as required.

It is an object of the present invention to provide an exercising machine which enables the user to exercise a variety of muscles using a pivotable movement with a sliding foot movement.

According to one aspect of the present invention there is disclosed an exercising apparatus comprising a frame having an upper body support which is pivotable about a horizontal axis and is supported by a frame, a feet support slideably engageable with an inclined track engageable with said frame wherein the user is able to be positioned between said upper body support and said feet support and slide said feet support along said track and pivot said upper body support as required to stretch and exercise.

One embodiment of the present invention will now be described with reference to the drawings in which.

Figure 1:
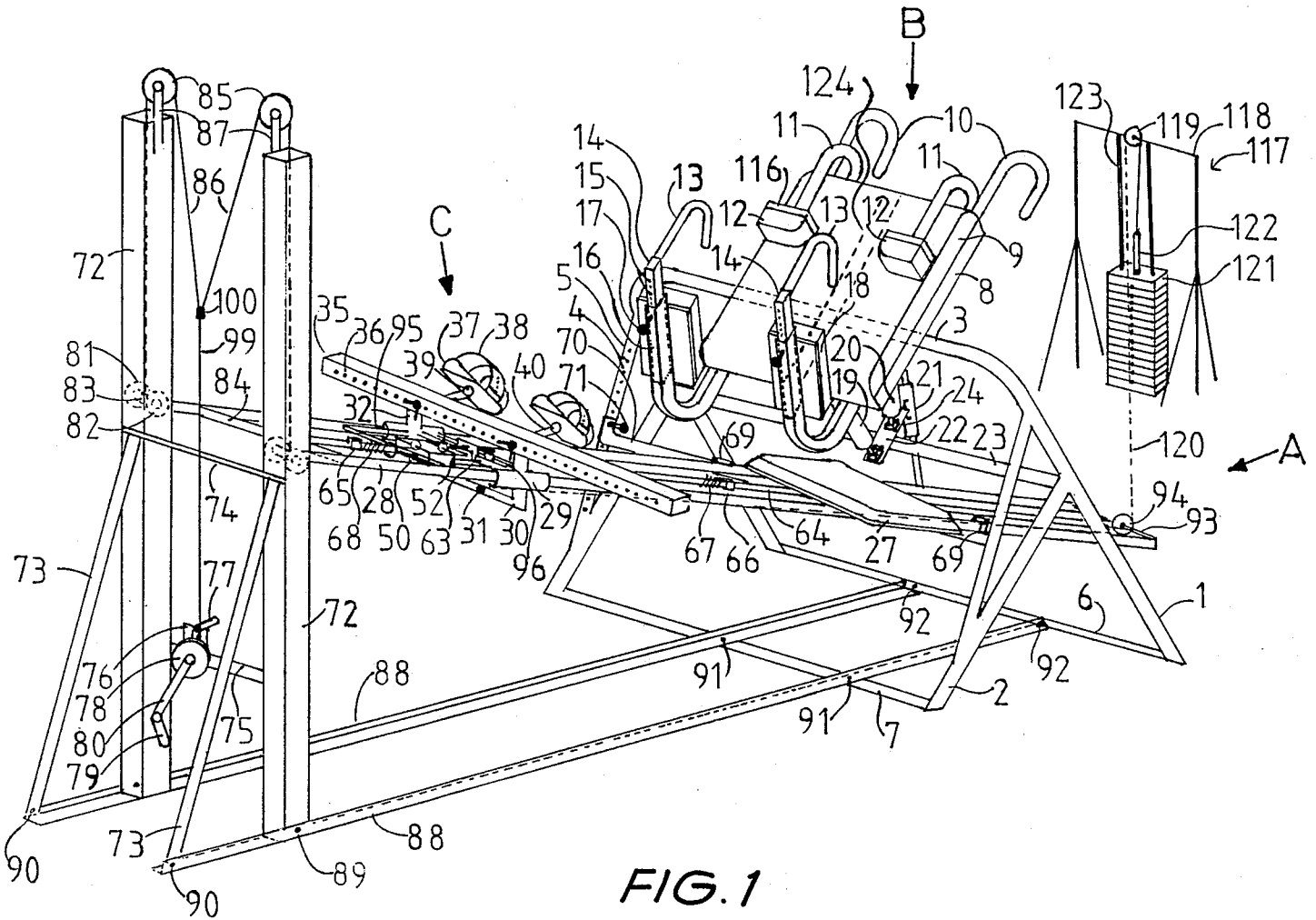
FIG. 1 is a perspective view of the exercising apparatus according to the invention.
Figure 2:
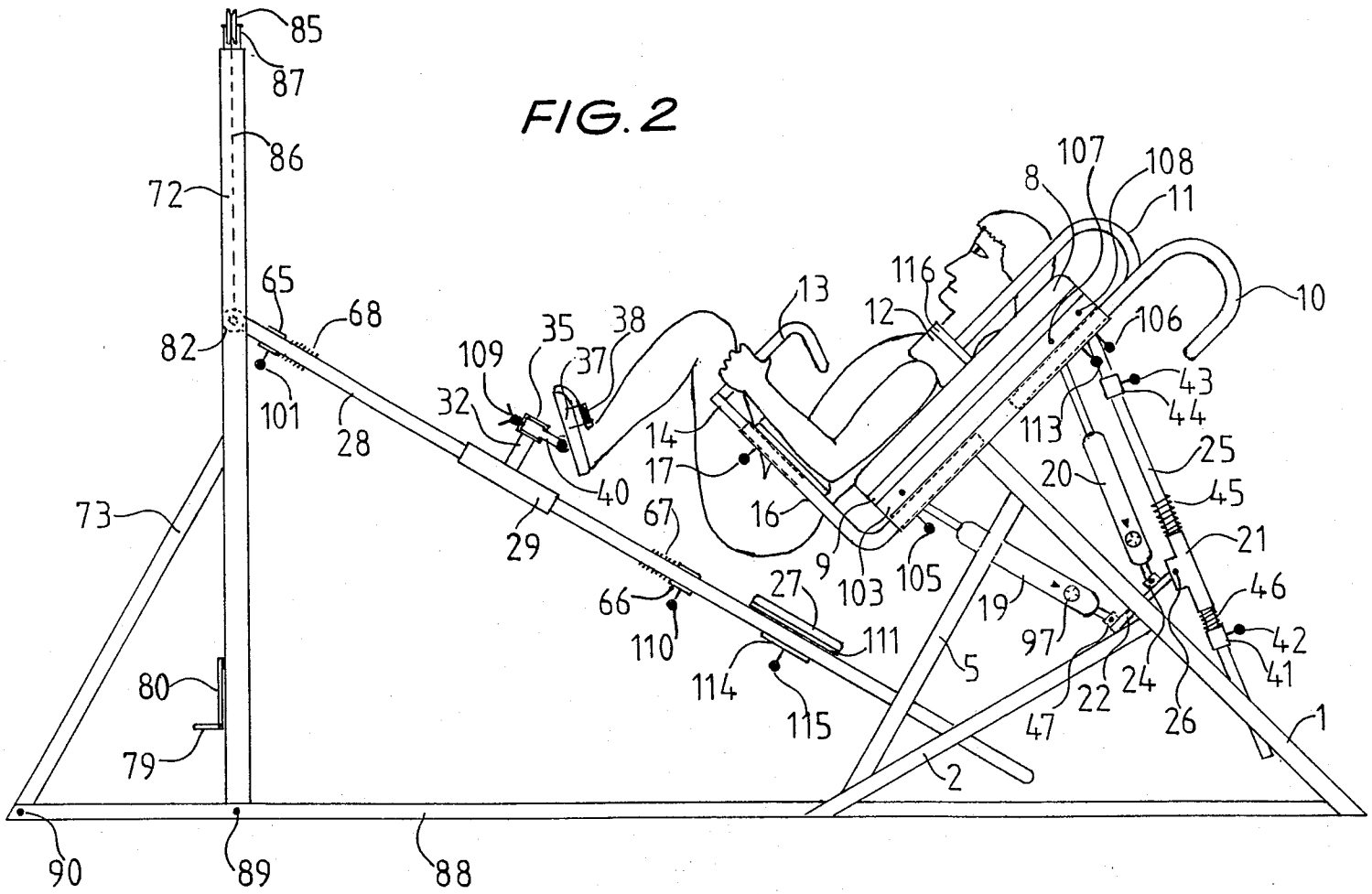
FIG. 2 is a side elevation of the exercising apparatus of FIG. 1 with the user positioned in the upper body support in an inclined position.

Referring mainly to FIGS. 1 and 2, the exercise apparatus comprises a pair of ground members 88, preferably made of steel angle bolted to a pair of horizontal cross members 6 and 7 and to a pair of upright channels 72. The connections are made with a nut and bolt 89 so that the various members 6,7,72 and 88 can be easily separated.

An A-frame A comprising structural inclined members 1 and 2 having a further cross member 3 is welded to the cross members 6 and 7 at their ends. The A-frame A further comprises another cross member 23 located at the junction of members 1 and 2 which separates both ends of the A-frame A thus providing strength as well as stability. The A-frame A also comprises a further bracing member 5 which has a plurality of holes 4 located along its length. The holes 4 face inward from the ends of the A-frame.

An upper body support B comprises a front cushion 9 which is pivotably connected to the cross member 3 by using a plurality of ball bearings (not illustrated). The cushion 9 pivots around the horizontal axis of the cross member 3. At the rear of the front cushion 9 connected to its board, is a pair of channels 103 to which a corresponding pair of rectangular steel tubing 102 are welded.

The upper body support B further comprises a pair of arm support cushions 18 and a pair of shoulder support cushions 12. The arm support cushions 18 are connected to a steel tube 16 which inserts into tubing 102. The arm support tubing 16 has a right angle bend and receives a further tube 14 to which a handle bar 13 is attached. The tube 14 is slidably engageable with the arm support tubing 16 and can be locked into any desired position by a springed locking pin 17 which fits into any one of a plurality of holes 15 located in the arm support tubing 14. This enables the handle 13 to be adjusted in accordance with the length of the user's forearm. Similarly, the shoulder support cushion 12 is connected to a base 116 which is further connected by a rounded tubing 11 which is receivable into a tubing (not illustrated) located next to the tubing 102. A handle bar 10 is also receivable into the tubing 102 and lockable by the spring loaded pin 106 in a similar manner to pin 17 whilst a spring loaded pin 113 locks the tubing 11 into place. The spring loaded pin 105 also adjusts the amount that the arm support tubing 16 extends from the tubing 102. All the positions of the upper body support B are adjustable to enable it to be used by a variety of users.

The upper body support B is supported by pistons 19 and 20 which are connected to the channel 124 which is located on the middle of the board 9, at points 104 and 107 and to points 24 and 47 locatable on an anchor plate 22. The pistons 19 and 20 are pressure adjustable by knobs 97 located on the cylinder thereof. To limit the inclination of the upper body support B, a further pivotable member 25 is pivotably connected to the channel 124 at point 108 and to the anchor plate 22 at point 26. On the pivotable member 25 a sliding stop member 41 and 44 are locked into position by a locking device which has preferably spring loaded pins 42 and 43 insertable into the holes located in the pivotable member 25. The pivotable member 25 slides through a collar 21. A pair of springs 45 and 46 are located between the collar 21 and the sliding stop members 41 and 44. The springs 45 and 46 surround the pivotable member 25 thus eliminating the sudden stopping of the pivotable member 25 as it reciprocates as the upper body support B pivots around the cross member 3.

The two bracing members 5 have a tubular rod 70 located between them. The tubular rod 70 can be adjusted up and down the length of the bracing members 5 by engaging the plurality of holes 4 with a spring loaded pin 71. This is to raise and lower the height of two cylindrical tracks 28 which rest on the rod 70. At the other end of the two tracks 28 the tracks 28 are connected to rod members 83 which have two rollers 81 and 82 at either end of the rod members 83. The rollers 81 and 82 roll up and down inside the upright channels 72. The rods 83 are connected to a wire 86 which runs over a pulley 85 on supports 87, and are joined at junction 100 as illustrated in FIG. 1. A further wire 99 is joined at the junction 100 and is connected to a winch apparatus 78 which tensions the wire 99 to raise and lower the tracks 28. The winch apparatus 78 is connected to a support member 75 which bridges the gap between the uprights 72. The winch apparatus 78 comprises a handle 79 which rotates the winding arm 80 of the winch apparatus 78. The ratchet 77 pivots on plate 76.

Also illustrated in FIG. 1,. a pair of bracing members 73 inclined to the horizontal are connected to a cross member 74 which is connected to the channels 72. The bracing members 73 are bolted at 90 to ground members 88.

The feet support C comprises collars 29 which slidably move along the tracks 28, preferably by a ball bearing mechanism. The collars 29 have support members 32 which are connected to rectangular cross member 35. A pair of supports 40 are adjustably connected to the rectangular cross member 35 and pivot a pair of feet rests 37 at point 39. Each of the feet rests 37 have a strap 38 to enable the feet to be secured therein. The position of the feet rest 37 can be adjusted along the length of cross member 35 by adjusting the tightening nut 109 and sliding the support 40 into any of the holes 36 located on the cross member 35.

Figure 5:
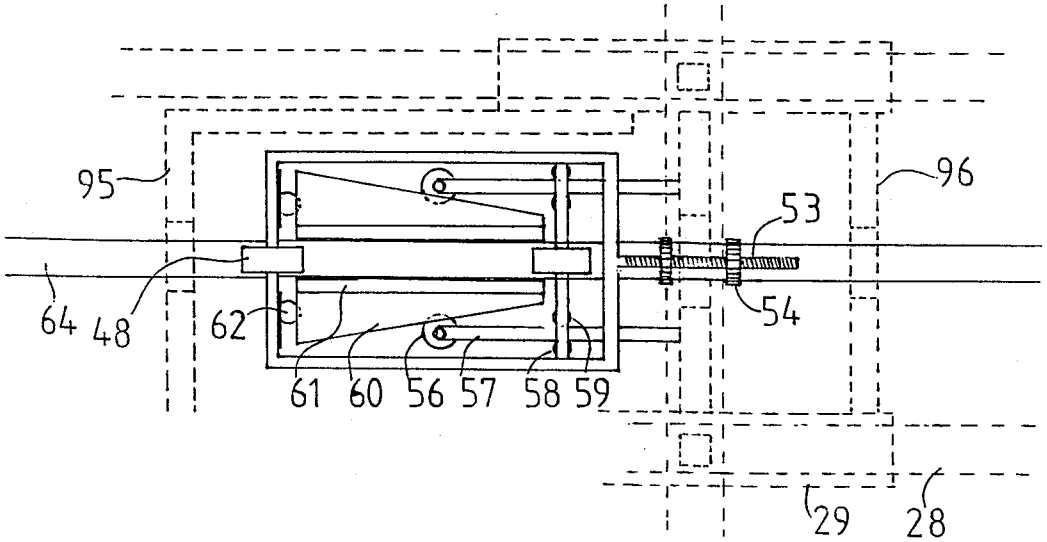
FIG. 5 is a top view of the braking system for the apparatus of the preferred embodiment.
Figure 6:
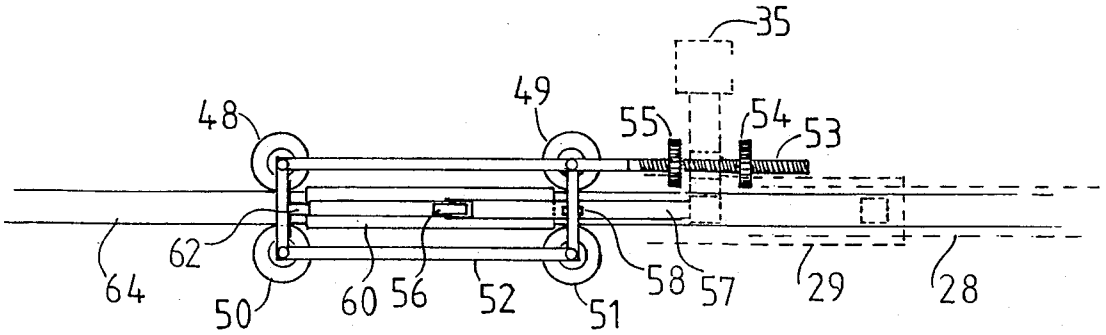
FIG. 6 is a side view of the braking system of FIG. 5.

The feet support C has a brake system which is illustrated in FIGS. 5 and 6 comprising a runner 64 which is parallel to the tracks 28. The runner 64 is welded at both ends by a cross bar 93 and 84 respectively. A pair of members 57 is attached to member 63 which is a cross piece between the support 30 of the collars 29. A frame 52 is adjustable due to the fact that an extruding rod 53 is threaded and has hand adjustable nuts 54 and 55 which can be turned to move the frame 52 backwards or forwards. This in effect controls the resistance required and the extent that a steel ball bearing 56 is able to roll up or down a groove on the inclined surface of the base plates 60 of the brake pads 61. As the ball bearings 56 are applied to the base plates 60, the brake pad 61 apply force on the rectangular runner 64. Extra ball bearings 48, 49, 50 and 51 roll along the runner 64 to enable movement. By adjusting the nuts 54 and 55 it is able to lock resistance in both directions or alternatively have resistance in only the forward direction. It is also possible to have no resistance with the adjustment of the nuts 54 and 55 along the threaded rod 53 as the ball bearings 56 would not effect any braking movement. On the runner 64 as illustrated in FIG. 1, a pair of arresting springs 68 and 67 are located being able to be locked into place by locking members 65 and 66 respectively. The cross pieces 95 and 96 which are connected to the collars 29 first contact the arresting springs 67 and 68 during the sliding movement of the feet support C along the tracks 28 and runner 64. The length of the slidable movement is adjusted by the locking devices 65 and 66 which engage a plurality of holes in the runner 64. Alternatively a pair of hand tightening bolts can be used (not illustrated).

A seat 111 has a front cushion 27. The seat 111 is able to be slid along the rectangular runner 64 and can be secured into position by a pin 115 passing through a base plate 114. Alternatively, it can be able to be slid between two stops (not illustrated) at similar to the manner described above for the collar 29.

Also illustrated in FIG. 1 is a weight stack arrangement 117 which can be associated with the exercising apparatus. A wire 120 connected to the weights 121 runs through a pair of pulleys 94 and 119 can be connected to the support member 30 at location 31. This arrangement can add a certain amount of resistance to the movement of feet support C. Also associated with the tracks 28 are guide member 69 which secure the tracks in place on the support tube rod 70.

In operation, the exercising apparatus as illustrated in FIG. 1 can be used in a number of ways. Basically, the exercising apparatus can have an optional weight stack arrangement 117 or can have a braking system attached if desired.

The upper body support B pivots on cross member 3 and has pistons 19 and 20 to adjust the amount of control of the swing. Also to limit the amount of swing of the upper body support the pivotal member 25 can be controlled by a par of spring and stop arrangements 41, 44, 45 and 46.

The upper body support B is able to be adjusted to suit the size of the user. The feet support C is able to be moved or slid along the runners 64 and tracks 28. Straps 38 are used to hold the user's feet in place. The tracks 28 are raised and lowered as required whilst the resistance on the feet support C can also be adjusted.

Figure 3:
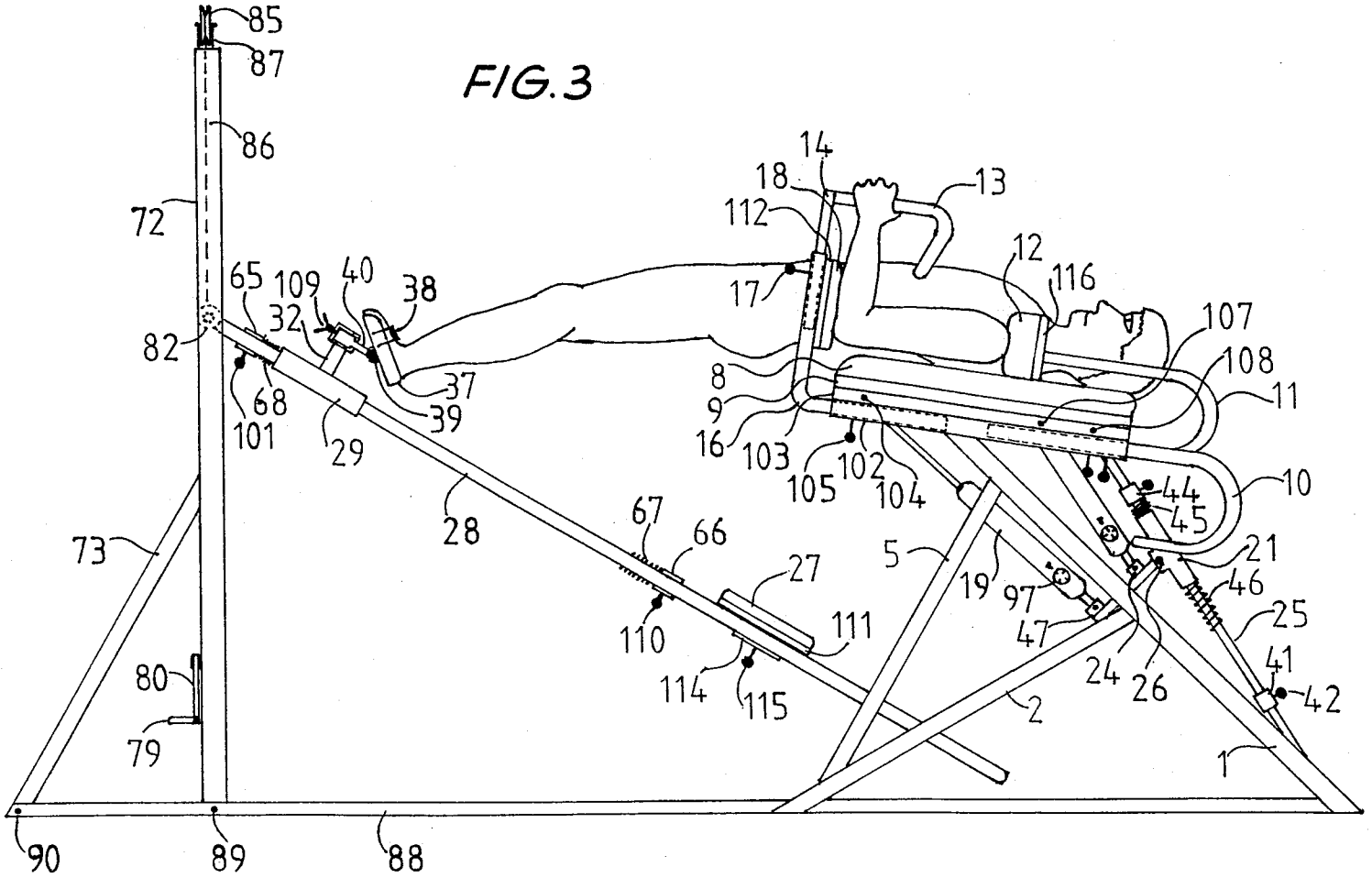
FIG. 3 is a side elevational view of the apparatus of FIG. 1 with the user positioned in the upper body support substantially horizontal.

As illustrated in FIGS. 2 and 3, one method of using the apparatus is carried out by the user lying on the upper body support B with his feet in the feet support C. As the user pushes the feet support C upwards along inclined slope of the tracks 28, he or she can also pivot the upper body support B to the position shown in FIG. 3 thus stretching the abdomen muscles as well as using his leg muscles to push the feet support 37 against a certain resistance.

Figure 4:
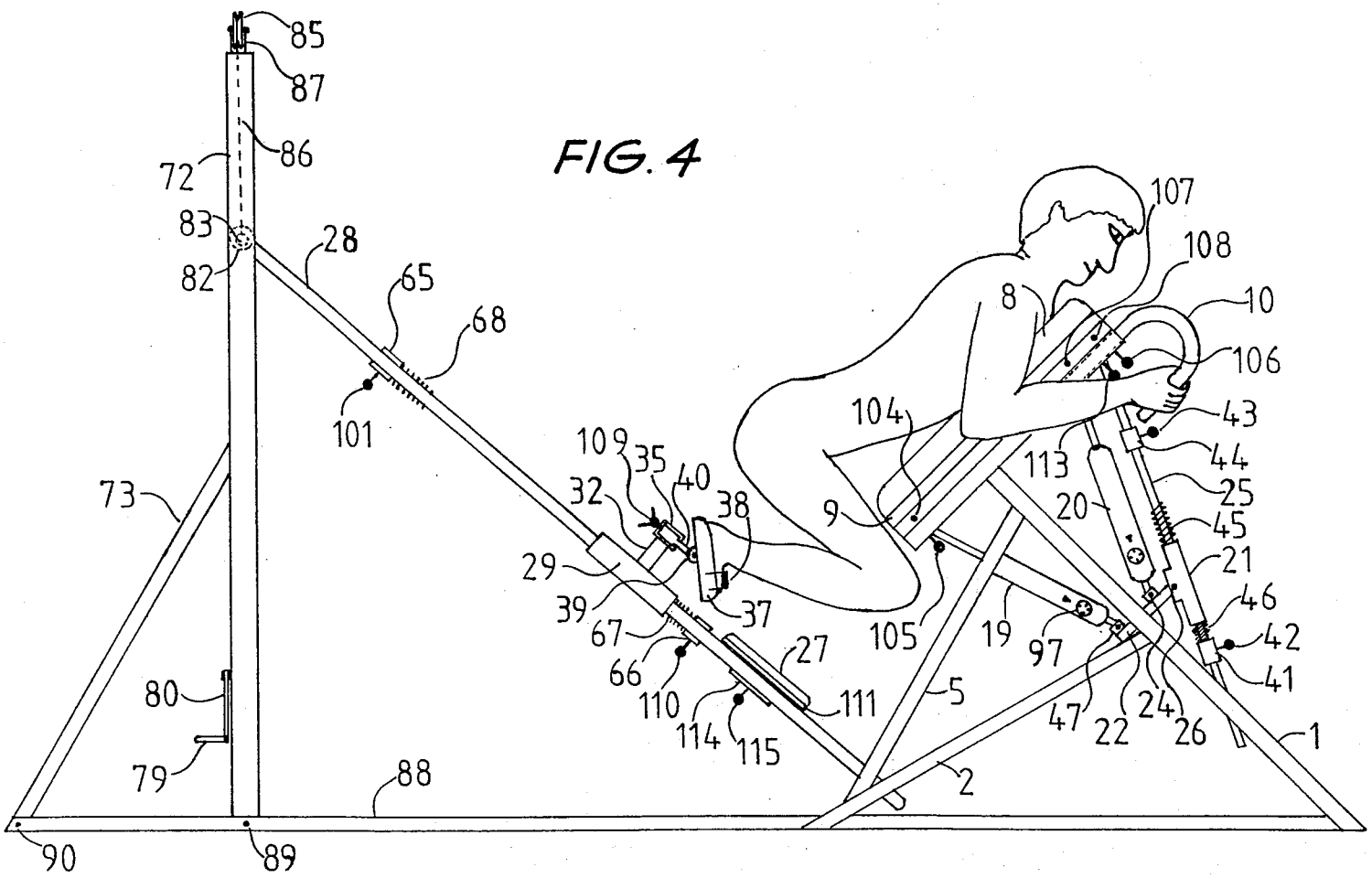
FIG. 4 is a side elevational view of the apparatus of FIG. 1 with the user having his chest on the upper body support.

Another use is illustrated in FIG. 4 when the user lies with his front to the upper body support B with his feet in the feet support 37. The user then reciprocally pushes the feet support C up and down the inclined slope whilst pivoting the upper body support B with each reciprocal movement. This method gives a stretching as well as exertive exercise.

The seat 111 is able to be used in the extent that the user sit on the seat 111 whilst pushing the feet support C. The user does not have to pivot the upper body support B or reciprocate feet support C all the time. By preventing movement of either the upper body support B or the feet support C the user is able to exercise different muscles to give a fairly wide range of exerting and stretching exercises.

The foregoing describes only one embodiment of the present invention, and modifications obvious to those skilled in the art can be made thereto without departing from the scope of the present invention.

For example, the feet rests 37 can be adjusted to have differing heights and locations by tilting the column 35 by adjustments to the supports 32. Also a variable piston applying a resistance can be connected between cross bar 93 and the support 30 of the feet support C at point 31.

WHAT WE CLAIM IS:

1. An exercising apparatus comprising a frame having an upper body support which is pivotable about a horizontal axis and is supported by said frame, an adjustable resistance means for providing a variable resistance to pivotal movement of said upper body support a feet support slideably engageable with a linear track supported by said frame, said track having a slope inclined relative to a horizontal plane and extending forwardly of said upper body support so that it faces towards the upper body support, wherein a user is able to be positioned between said upper body support and said feet support and slide said feet support along said track and pivot said upper body support as required to stretch and exercise.

2. The exercising apparatus as claimed in claim 1 wherein both the movement of said feet support and said upper body support each have variable resistance applied separately thereto by resistance adjustment means.

3. The exercising apparatus as claimed in claim 2 wherein the pivotal movement of the upper body support can be prevented by a set of stops operatively connected to a pivotal member of the upper body support.

4. The exercising apparatus as claimed in claim 2 wherein resistance to the movement of said upper body support is provided by resistance means comprising a pair of variable pistons operatively connected to a pivotal member of the upper body support.

5. The apparatus as claimed in claim 2 wherein the slope of the track is adjustable by a track height adjustment means.

6. The apparatus as claimed in claim 2 wherein said apparatus is dismantable and transportable.

7. The exercising apparatus as claimed in claim 2 wherein resistance to the movement of said feet support is provided by resistance means comprising any one of a stack of weighs operatively connected to said feet support, or a variable piston operatively connected to said feet support, or a braking means operatively connected to said feet support comprising brake pads attached to said feet support, said brake pads being engageable with said track.

8. The exercising apparatus as claimed in claim 7 wherein resistance to the movement of said upper body support is provided by resistance means comprising a pair of variable pistons operatively connected to a pivotal member of the upper body support.

9. The exercising apparatus as claimed in claim 7 wherein the pivotal movement of the upper body support can be prevented by a set of stops operatively connected to a pivotal member of the upper body support.

10. The exercising apparatus of claim 1 wherein said adjustable resistance means may vary the resistance to movement from no resistance to prevention of movement.

11. The exercising apparatus as claimed in claim 10 wherein resistance to the movement of said feet support is provided by resistance means comprising any one of a stack of weights operatively connected to said feet support, or a variable piston operatively connected to said feet support, or a braking means operatively connected to said feet support comprising brake pads attached to said feet support, said brake pads being engageable with said track.

12. The exercising apparatus as claimed in claim 10 wherein resistance to the movement of said upper body support is provided by resistance means comprising a pair of variable pistons operatively connected to a pivotal member of the upper body support.

13. The exercising apparatus as claimed in claim 10 wherein the pivotal movement of the upper body support can be prevented by a set of stops operatively connected to a pivotal member of the upper body support.

14. The apparatus as claimed in claim 10 wherein the slope of the track is adjustable by a track height adjustment means.

15. The apparatus as claimed in claim 10 wherein said apparatus is dismantable and transportable.

16. The exercising apparatus as claimed in claim 1 wherein resistance to the movement of said upper body support can be adjusted by resistance means comprising a pair of variable pistons operatively connected to a pivotal member of the upper body support.

17. The exercising apparatus as claimed in claim 16 wherein the pivotal movement of the upper body support can be prevented by a set of stops operatively connected to a pivotal member of the upper body support.

18. The apparatus as claimed in claim 1 wherein the slope of the track is adjustable by a track height adjustment means.

19. The apparatus as claimed in claim 1 wherein said apparatus is dismantable and transportable.

* * * * *